US007770257B2

(12) United States Patent
Kim

(10) Patent No.: US 7,770,257 B2
(45) Date of Patent: Aug. 10, 2010

(54) VACUUM CLEANER AND SUCTION NOZZLE STRUCTURE THEREOF

(75) Inventor: Kyung Chul Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 769 days.

(21) Appl. No.: 11/100,539

(22) Filed: Apr. 7, 2005

(65) Prior Publication Data

US 2006/0042043 A1 Mar. 2, 2006

(30) Foreign Application Priority Data

Aug. 30, 2004 (KR) ..... 10-2004-0068377

(51) Int. Cl.
*A47L 9/04* (2006.01)
*A47L 5/26* (2006.01)

(52) U.S. Cl. ..... 15/412; 15/246.2; 15/328; 15/344; 15/387

(58) Field of Classification Search ..... 15/352, 15/353, 347, 337, 523, 528, 379, 334, 383, 15/422, 412, 414, 415.1, 387, 344, 328, 321, 15/322, 246.2
See application file for complete search history.

(56) References Cited

U.S. PATENT DOCUMENTS

| | | | | | |
|---|---|---|---|---|---|
| 4,685,171 | A * | 8/1987 | Beaudoin | 15/391 |
| 5,351,362 | A * | 10/1994 | Kramer et al. | 15/387 |
| 5,797,162 | A * | 8/1998 | Vystrcil et al. | 15/323 |
| 6,003,196 | A * | 12/1999 | Wright et al. | 15/353 |
| 6,279,196 | B2 * | 8/2001 | Kasen et al. | 15/320 |
| 6,375,696 | B2 * | 4/2002 | Wegelin et al. | 55/337 |
| D462,813 | S * | 9/2002 | Nakano et al. | D32/22 |
| 6,481,043 | B1 * | 11/2002 | Anderson et al. | 15/246.2 |
| 6,502,278 | B2 * | 1/2003 | Oh et al. | 15/353 |
| 6,513,190 | B1 * | 2/2003 | Allgeier et al. | 15/387 |
| 6,532,620 | B2 * | 3/2003 | Oh | 15/353 |
| 6,711,777 | B2 * | 3/2004 | Frederick et al. | 15/387 |
| D516,760 | S * | 3/2006 | Choi | D32/22 |
| 7,296,324 | B2 * | 11/2007 | Lee | 15/415.1 |
| 2003/0024069 | A1 * | 2/2003 | Bair et al. | 15/352 |

* cited by examiner

*Primary Examiner*—Gary K Graham
(74) *Attorney, Agent, or Firm*—KED & Associates LLP

(57) ABSTRACT

Provided is a mini nozzle protected by upper and lower covers, the upper and lower covers being combined by hooking so that a user may handle conveniently.

19 Claims, 6 Drawing Sheets

VACUUM CLEANER AND SUCTION NOZZLE STRUCTURE THEREOF

BACKGROUND OF THE INVENTION

1. Field of the Invention

The present invention relates to a vacuum cleaner, and particularly to a suction nozzle of the vacuum cleaner that gives improved convenience in use. More particularly, the present invention relates to a suction nozzle structure of an upright vacuum cleaner that allows a user to clean inside of a mini nozzle conveniently and to assemble and dissemble the mini nozzle in a simple way by improving structure of the mini nozzle used for cleaning a corner which is not contacted with a main body of the vacuum cleaner.

2. Description of the Related Art

A vacuum cleaner is generally classified into a canister vacuum cleaner and an upright vacuum cleaner. Particularly, the upright vacuum cleaner includes a main body, a nozzle unit and a handle that are integrally formed, so the vacuum cleaner itself is moved when a user pushes or pulls a handle with gripping it. At this time, dusts on the floor are sucked through the nozzle to clean the floor. A general configuration of such an upright vacuum cleaner is already well known in many documents, so it is not described here in detail.

Meanwhile, the upright vacuum cleaner has a limitation in cleaning the whole indoor space due to its own shape. In more detail, since the upright vacuum cleaner has the main body, the main nozzle unit and the handle integrated and the whole vacuum cleaner moves at the same time during the cleaning process, it has many restrictions in view of space to be cleaned. For example, the main nozzle of the upright vacuum cleaner cannot reach a corner or an edge of such as a stairway, the corner or edge cannot be cleaned. In order to solve this problem, there had been proposed an upright vacuum cleaner in which only a hose may be separated from the suction nozzle body and then a mini nozzle is connected to an end of the separated hose. That is to say, with the main body of the upright vacuum cleaner being placed at its original position, the mini nozzle is connected to the end of the suction hose and a user cleans corners and edges with moving only the mini nozzle.

Meanwhile, the mini nozzle has a small size. Thus, in order to assemble the mini nozzle, with inner components being received in the mini nozzle, upper and lower covers are combined later by using a combination part such as a screw.

However, this method of combining the upper and lower covers by a screw is inconvenient for repairing or cleaning inside of the mini nozzle since a user cannot watch the inside of the mini nozzle until it is dissembled.

In addition, in order to prepare a separate space for forming the screwing structure, there are additionally needed separate protrusions for combination, which is very inefficient to the mini nozzle having a small size.

Moreover, since the mini nozzle has a small size, a user may grip and handle it in an easy and convenient way, but it is very disadvantageous that the upper and lower covers of the mini nozzle are firmly fixed with each other so that it cannot be separated. In particular, when a user intends to clean inside of the mini nozzle, an unscrewing process should be conducted inconveniently.

SUMMARY OF THE INVENTION

Accordingly, the present invention is directed to an upright vacuum cleaner that substantially obviates one or more problems due to limitations and disadvantages of the related art.

An object of the invention is to provide a suction nozzle structure of a vacuum cleaner that is capable of giving improved convenience to a user by allowing simple dissembling of a mini nozzle.

Another object of the invention is to provide a suction nozzle structure of a vacuum cleaner that allows a user to watch its inside with gripping it by one hand in a convenient way and then clean its inner components.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a vacuum cleaner, which includes: a suction nozzle unit; a body for receiving a dust collecting unit in which foreign particles are separated from air sucked through the suction nozzle unit; a manipulation handle formed at an upper portion of the body, for manipulating operation of the vacuum cleaner; a hose connecting the suction nozzle unit with the body so as to act as an air passage; a mini nozzle selectively connected with the hose; a mini nozzle seat formed on the body, for selectively receiving the mini nozzle; upper and lower covers for protecting upper and lower portions of the mini nozzle; an elastic hooking protrusion formed by cutting away a selected one of the upper and lower covers; and a slit formed at the other one of the upper and lower covers such that the elastic hooking protrusion is hooked thereto to fix the upper and lower covers.

In another aspect of the invention, there is provided a suction nozzle structure of a vacuum cleaner, which includes: an upper cover for protecting an upper portion of a suction nozzle; a lower cover for protecting a lower portion of the suction nozzle; an elastic hooking protrusion formed on a side of a selected one of the upper and lower covers and elastically transformed when being pushed by a user; and a slit formed in the other one of the upper and lower covers such that the elastic hooking protrusion is partially inserted and fixed therein.

In still another aspect of the invention, there is provided an upright vacuum cleaner, which includes: a main suction nozzle unit for sucking an outer air from a lower side of the upright vacuum cleaner; a body for receiving a dust collecting unit in which foreign particles sucked through the main suction nozzle unit is collected; a manipulation handle for manipulating the upright vacuum cleaner; a hose for connecting the main suction nozzle unit with the body; a mini nozzle selectively connected with the hose and protected by at least two covers; an elastic hooking protrusion formed in a side of a selected one of the covers and elastically transformed when being pushed by a user; and a slit formed in the other one of the covers such that the elastic hooking protrusion is partially inserted and fixed therein.

By using the supposed configuration, the suction nozzle may be handled in an easier way, and inside of the suction nozzle may be cleaned in a more convenient way.

In addition, since the mini nozzle does not require any separate combining structure, the mini nozzle may have a small size.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. However, the spirit of the invention is not limited to the embodiments, but those skilled in the art might easily propose other embodiments by adding, changing, deleting or modifying components within the scope of the invention.

Figure 1:
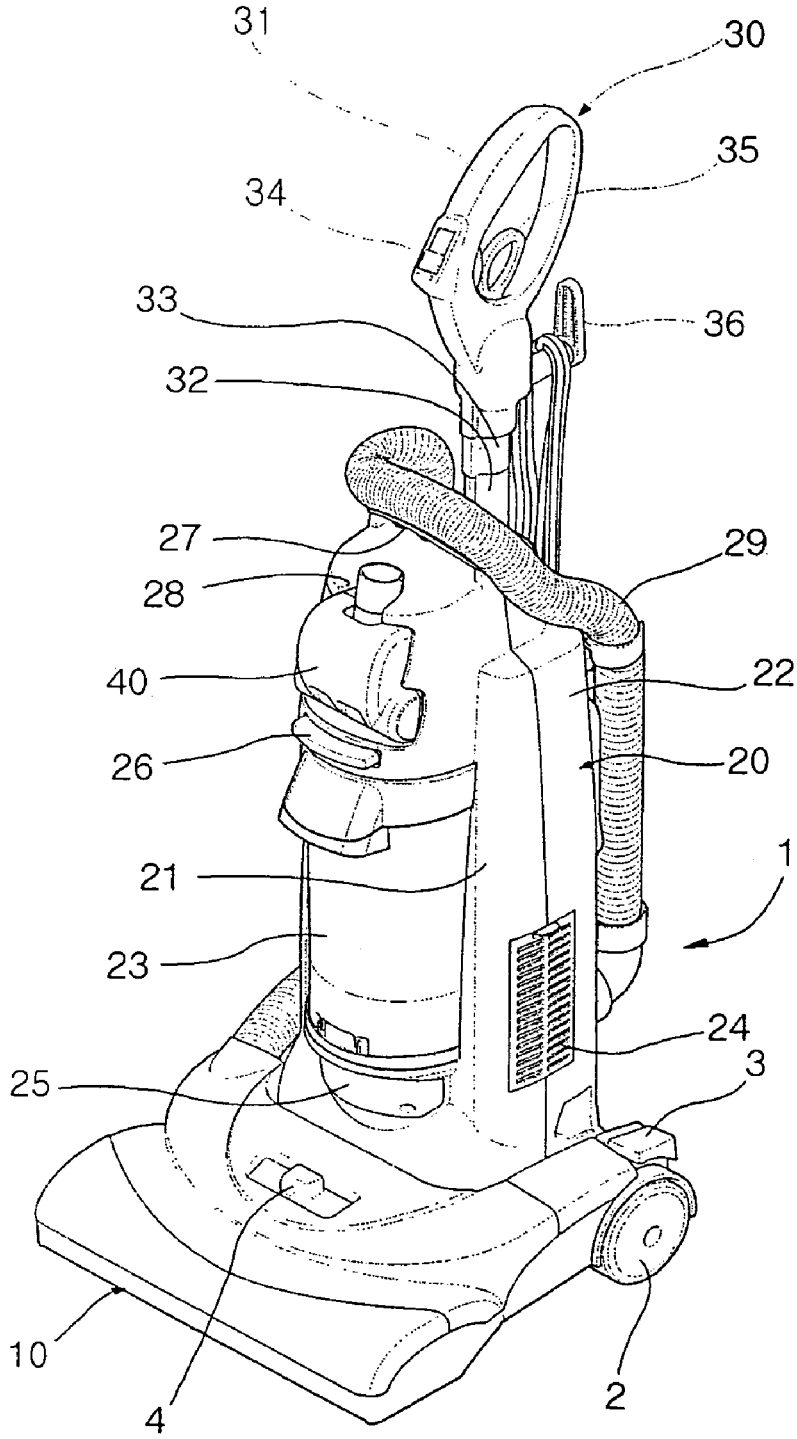
FIG. 1 is a front perspective view showing an upright vacuum cleaner according to the present invention.
Figure 2:
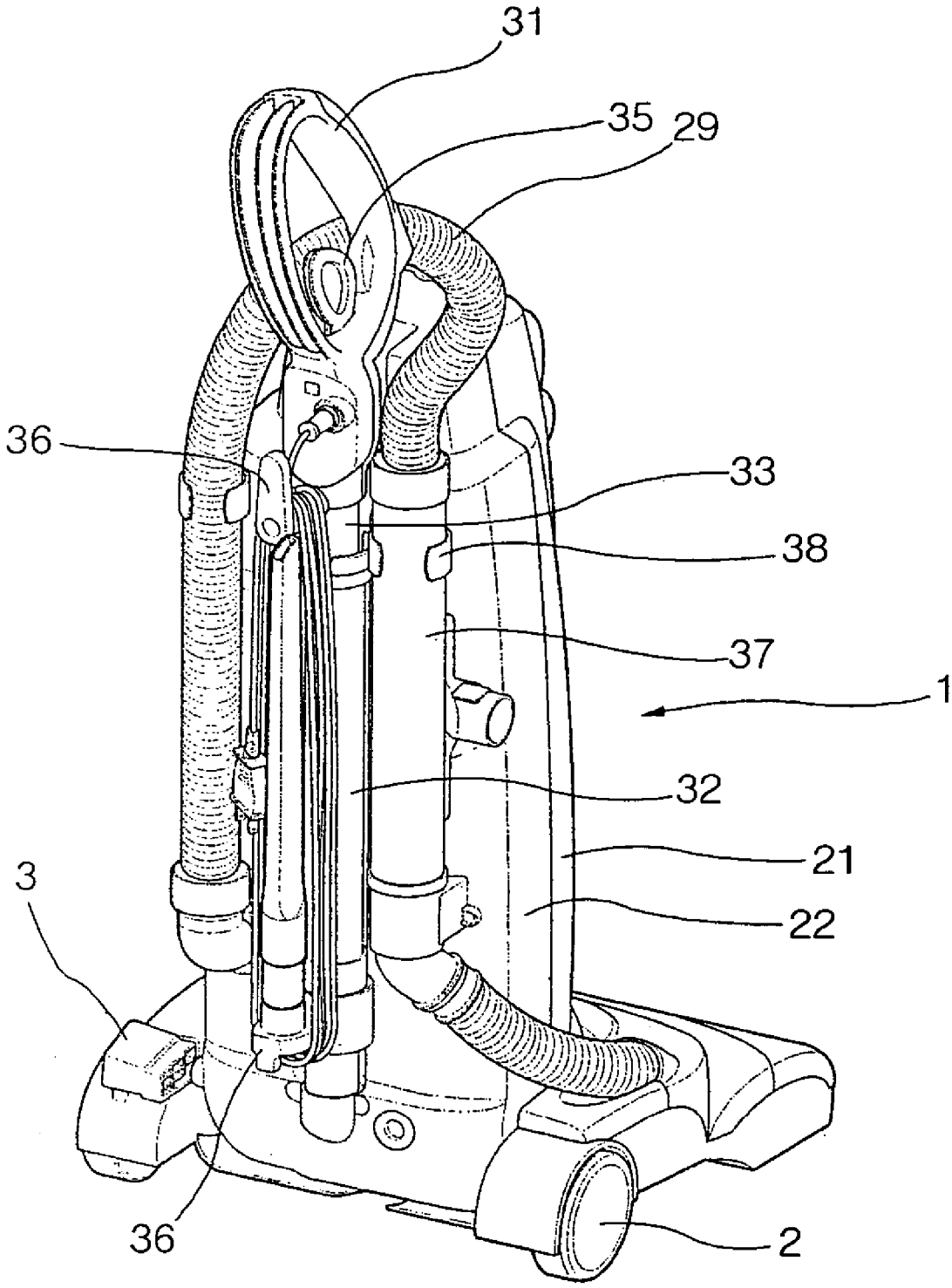
FIG. 2 is a rear perspective view showing an upright vacuum cleaner according to the present invention.

FIG. 1 is a front perspective view of an upright vacuum cleaner according to the present invention, and FIG. 2 is a rear perspective view of the upright vacuum.

Referring to FIGS. 1 and 2, the upright vacuum cleaner 1 of the present invention macroscopically includes a suction nozzle unit 10 contacted with a floor, for sucking an outer air, a body 20 in which main parts such as a suction motor and a fan are mounted, and a manipulation handle 30 formed on an upper portion of the vacuum cleaner such that the vacuum cleaner is moved in an easy way during the cleaning work. The cleaning work using the vacuum cleaner is conducted as follows. First, air is sucked through the suction nozzle unit 10 together with foreign particles. The foreign particles are separated from the sucked air while passing through the body 20 by means of a cyclone manner or a filtering manner so that the sucked air is cleaned, and then the cleaned air is exhausted through a predetermined discharge hole. In addition, in order to move the vacuum cleaner to a desired position, a user grips the manipulation handle 30 of the vacuum cleaner and then pulls or pushes the vacuum cleaner.

In detail, the suction nozzle unit 10 is used for sucking an outer air and has a substantially rectangular shape with an opening opened toward the floor. The suction nozzle unit 10 is hinged to the body 20, and a pivoting lever 3 controls this hinge movement. In addition, for better movement of the suction nozzle unit 10, the suction nozzle unit f10 further includes wheels 2 installed at a rear portion of the suction nozzle unit 10, and a height control knob 4 installed on an upper surface of the suction nozzle unit 10 for height control of the suction nozzle unit 10. The air sucked into the suction nozzle unit 10 is guided to the body 10 by means of a hose 29. For this purpose, both ends of the hose 29 are respectively connected to the suction nozzle unit 10 and the body 20, and the hose 29 has so sufficient length to wind an upper portion of the vacuum cleaner once so that the hose 29 may be moved to a distance conveniently.

The body 20 includes a front case 21 for protecting a front portion of the body and a rear case 22 for protecting a rear portion of the body, and the front and rear portions are fixed with each other by a certain manner such as fitting or screwing. Furthermore, the body 20 is provided with a dust collecting unit 23 for collecting dusts from the air sucked through the hose 29, a detachable lever 26 for separating the dust collecting unit 23 from the body 20 in a convenient way, a discharge cover 24 formed in a side of the body for allowing the air free from foreign particles to be discharged, a lamp 25 for giving a light to the floor at night so that the vacuum cleaner may be manipulated in a convenient way, a mini nozzle seat 28 depressed in the top of the front case 21, and a mini nozzle 40 selectively received in the mini nozzle seat 28. The mini nozzle 40 may be used for cleaning places that are not directly contacted with the main body of the upright cleaner like a corner and received in the mini nozzle seat 28 during a custody time. The mini nozzle 40 is an example of suction nozzles through which an air is sucked, which will be described in more detail later.

In addition, the body 20 is also provided with, on its rear side, a code hook 36 protruded at upper and lower positions of the body 20 so that a power line is wound kept in custody thereon, a hose guide 37 that configures at least a part of the hose 29 and is made of strong materials unlike the hose 29, and a holder 38 protruded on the rear side of the body 20 so as to support the hose guide 37. The hose guide 37 is used for convenient positioning of the mini nozzle 40 when the mini nozzle is used in connection to the hose 29.

Meanwhile, to the hose guide 27, another suction nozzle unit like the mini nozzle 40 may be conveniently connected. For this purpose, one end of the hose guide 37 connected to the hose 29 is easily separated, and then another suction nozzle unit such as the mini nozzle 40 may be connected thereto. In addition, the hose 29 has a bellows shape, so its length may be shortened while being kept in custody and elongated over five times when being used by a user. Thus, the hose 29 allows a user to clean a place far away from the main body of the vacuum cleaner.

In addition, at the top of the front case 21, the hose 29 may be seated in a shrunk state, and a carrying handle 27 is formed for a user to grip to carry the vacuum cleaner. The carrying handle 27 may be used not only for holding and carrying the vacuum cleaner but also for holding the hose 29.

In detail, the manipulation handle 30 includes a handle grip 31 for a user to grip conveniently while the vacuum is operating, and an operation switch 34 formed at a predetermined position of the handle grip 31 and used for controlling operation of the vacuum cleaner itself such as initiation of operation of the vacuum switch and suction force of the vacuum cleaner. In addition, a length of the manipulation handle 30 may be conveniently adjusted. In more detail, for adjustment of length, the manipulation handle 30 includes an extension pipe 33 extended below the handle grip 31, and a fixed pipe 32 that supports the extension pipe 33 and allows the extension pipe 33 to be moved through it by means of selective manipulation of an extension lever 35 so that the length of the manipulation handle 30 may be shortened or elongated.

Among the components of the vacuum cleaner, the present invention mainly has an interest on the mini nozzle 40, particularly on structural improvement of the mini nozzle 40. Thus, the suction nozzle structure of the vacuum cleaner according to the present invention is not limited to the upright vacuum cleaner shown in FIGS. 1 and 2, but may be employed in a canister vacuum cleaner or other kinds of suction nozzles in an easy way.

Figure 3:
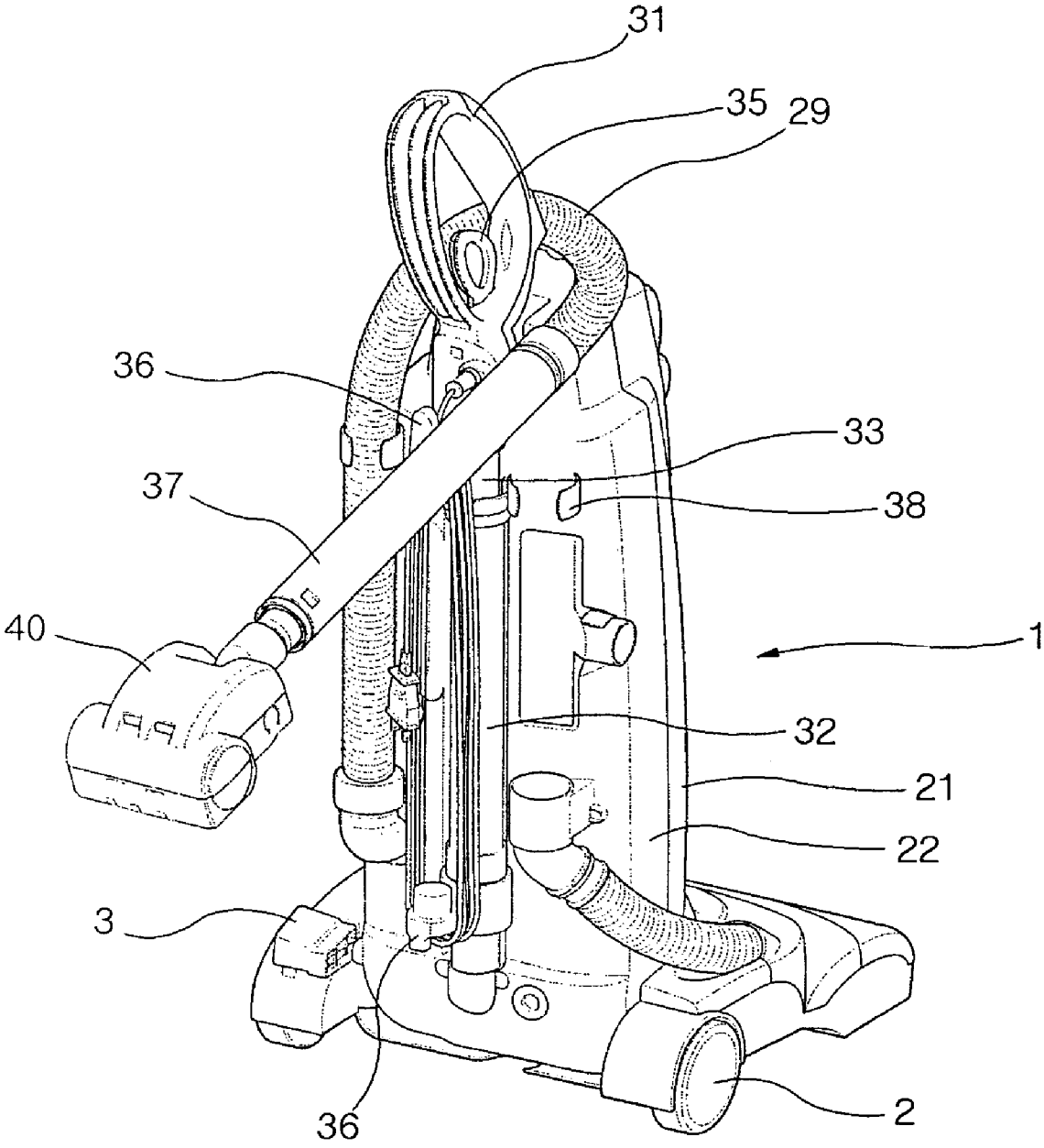
FIG. 3 is a perspective view showing a used state of a mini nozzle of an upright vacuum cleaner according to the present invention.

FIG. 3 is a perspective view illustrating a used state of the mini nozzle.

Referring to FIG. 3, the mini nozzle 40 is separated from the mini nozzle seat 28 and then connected to the hose guide 37. Thus, with the body 20 of the vacuum cleaner being fixed, a user may clean a room with moving just the hose 29 and the hose guide 37. In other words, while the body 20 of the vacuum cleaner 1 and the suction nozzle unit 10 are fixed to a position, the mini nozzle 40 may be used for cleaning with moving the hose 29. At this time, a user may grip the hose guide 37 to move the mini nozzle 40. In particular, the mini nozzle 40 has a small size, so it may be conveniently used for cleaning a place such as a corner or a stairway that is not easily cleaned by the vacuum cleaner.

Figure 4:
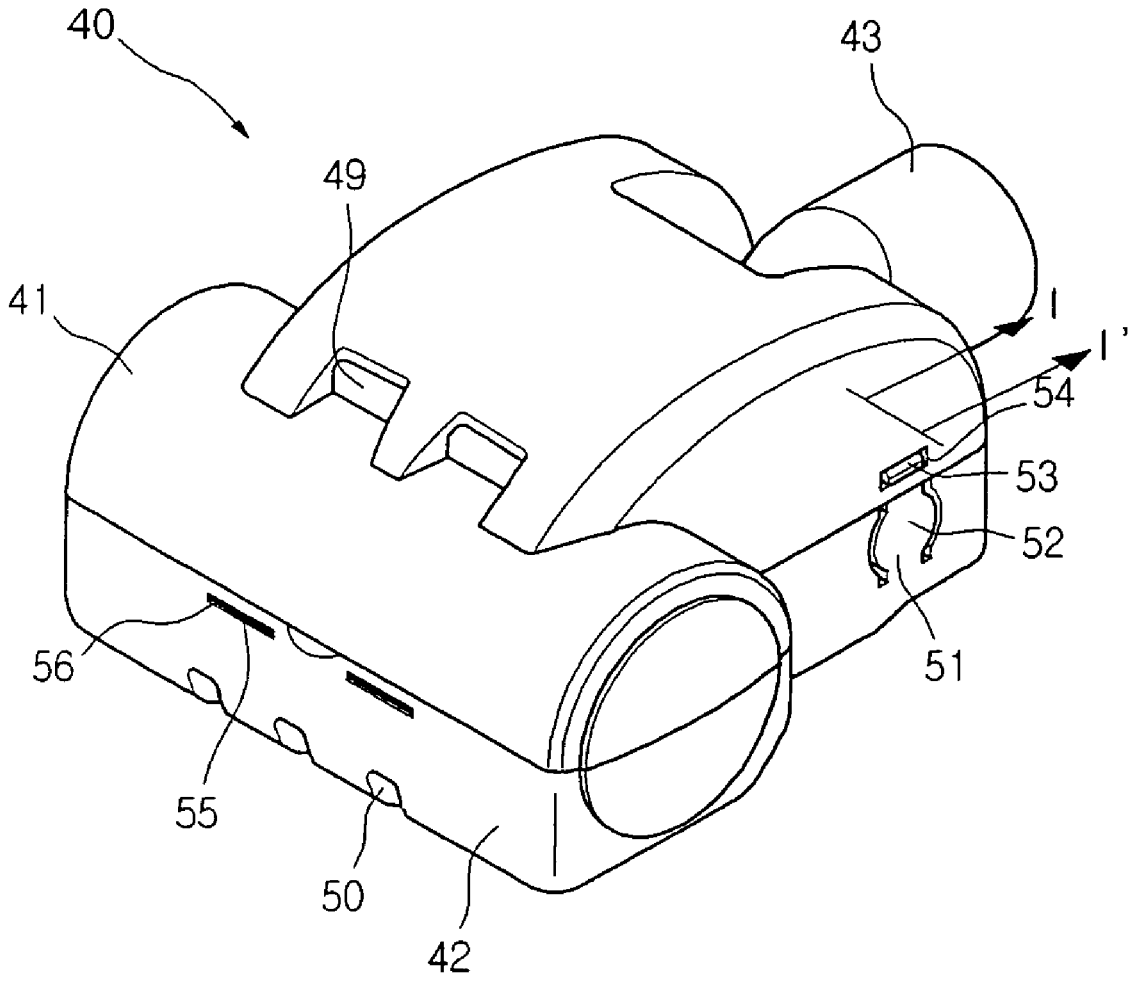
FIG. 4 is a perspective view of a mini nozzle adopted in an upright vacuum cleaner according to the present invention.
Figure 5:
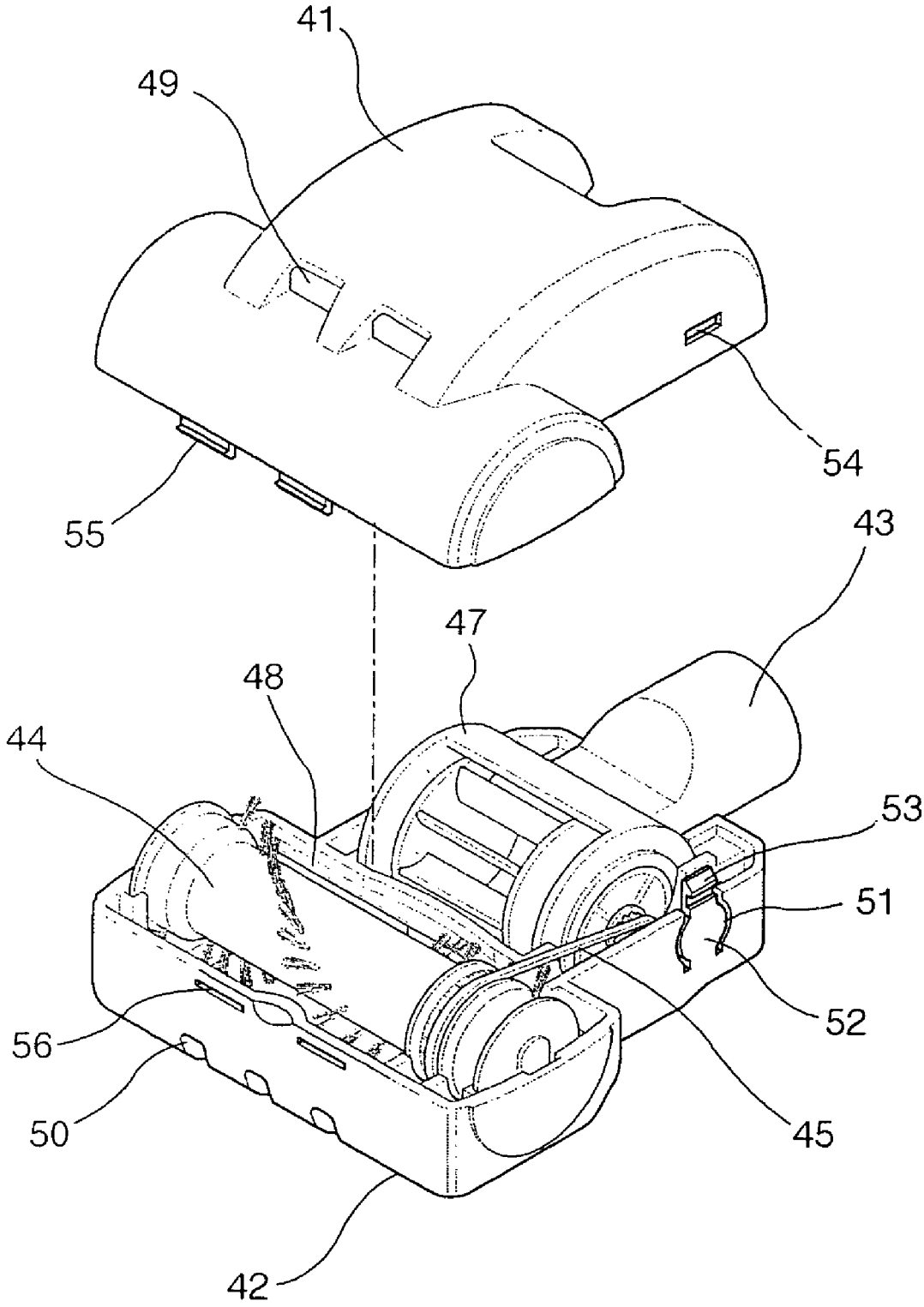
FIG. 5 is a perspective view showing a mini nozzle at a state where an upper cover is separated from a suction nozzle according to the present invention.

FIG. 4 is a perspective view showing a mini nozzle according to the present invention, and FIG. 5 is a perspective view showing a mini nozzle whose upper cover is separated from the suction nozzle.

Referring to FIGS. 4 and 5, the mini nozzle 40 according to the spirit of the present invention includes an upper cover 41 for protecting an upper portion of the mini nozzle 40, a lower cover 42 for protecting a lower portion of the mini nozzle 40, and a suction tube 43 for sucking an air discharged from the mini nozzle 40 into the hose guide 37. In addition, the mini nozzle 40 includes, in its inner place, an agitator 44 mounted at a front portion of the mini nozzle 40 to float dusts on the floor for improved cleaning efficiency, a turbine housing 47 mounted to an inner end of the suction tube 43, a turbine 46 placed in the turbine housing 47 and rotated by the air flowing in the turbine housing 47, and a belt 45 connected to rotational axes of the turbine 46 and the agitator 44. Moreover, an air guide 48 for partitioning the inner space of the mini nozzle 40 into an agitator receiving space and a turbine receiving space is formed such that airflow is guided toward the turbine more easily.

In addition, a suction hole (not shown) for sucking air on the floor is formed in a lower surface of the lower cover 42. A bypass channel is also formed such that air is bypassed and sucked when the suction hole (not shown) is blocked by flexible members such as a carpet. In detail, the bypass channel includes a first bypass channel 50 formed at a lower edge of a front surface of the lower cover 42, and a second bypass channel 49 formed in an upper surface of the upper cover 41. By the bypass channels 49 and 50, air is bypassed and sucked into the mini nozzle 40, thereby preventing a motor in the body of the vacuum cleaner from being overheated.

As one feature of the present invention, the upper and lower covers 41 and 42 are combined to each other by a hooking manner, and the upper and lower covers 41 and 42 are separated from each other by means of a pushing behavior of a user. Now, combining and separating methods of the covers 41 and 42 are described in detail.

A second hooking protrusion 55 is protruded downward at a front edge of the upper cover 41, and a second slit 56 is formed in the lower cover 42 at a position corresponding to the second hooking protrusion 55. In addition, an elastic hooking protrusion 51 is formed by cutting away the lower cover 42 in both sides of the lower cover 42, and a first slit 54 is formed in the upper cover 41 at a position corresponding to the elastic hooking protrusion 51. In more detail, the elastic hooking protrusion 51 includes a push portion 52 relatively widely formed in a circular shape with a size suitable for the finger of a user so that the user may push the elastic hooking protrusion 51 in an easier way, and a first hooking protrusion 53 formed in an upper portion of the push portion 52 and inserted into the first slit 54.

The first and second slits 54 and 56 may be grooves depressed at predetermined positions of the covers 41 and 42 or holes formed through the covers 41 and 42. In addition, the first and second hooking protrusions 53 and 55 are respectively inserted into the first and second slits 54 and 56 such that they are hooked to each other and not separated. The push portion 52 is circular and wide so that a user may conveniently push it. Thus, the push portion 52 gives convenience to a user who pushes it, and this pushing work is not disturbed by other fingers. In another aspect of the elastic hooking protrusion 51, the push portion 52 is circular and wide so as to be conveniently pushed by a user, and the first hooking protrusion 53 has a narrow lateral width so that the first hooking protrusion 53 may be elastically transformed by a little force. That is to say, the first hooking protrusion 53 is narrow in order to ensure easy transformation of the first hooking protrusion 53, while the push portion 52 is wide in order to allow a user to push it easily.

As a result, the elastic hooking protrusion 51 is formed by cutting away the lower cover 42 such that the push portion 52 is wider than the first hooking protrusion 53. Since the lower cover 42 is made of relatively thicker plastic and not easily transformed, such width difference between the first hooking protrusion 53 and the push portion 52 ensures easy transformation of the elastic hooking protrusion 51 and convenient manipulation of a user. In addition, though not shown in the figures, the elastic hooking protrusion 51 and the first slit 54 preferably formed in both sides of the mini nozzle 40 so that the covers 41 and 42 may be combined more firmly.

Referring to FIGS. 4 and 5, operation and function of the mini nozzle according to the spirit of the present invention will be described. If negative pressure is generated in the suction tube 43 by means of operation of the vacuum cleaner, air is strongly sucked through the suction hole (not shown). Of course, the suction tube 43 is connected to the body 20 of the vacuum cleaner by means of the hose guide 37 and the hose 29 to communicate with a suction fan (now shown) of the body 20 so that negative pressure may be generated. In addition, together with the air sucked through the suction hole, foreign particles on the floor are rapidly sucked toward the turbine 46. The rapid airflow rotates the turbine 46, and is then sucked into the main body of the vacuum cleaner via the suction tube 43. In addition, since the rotational axis of the turbine 46 is connected to the rotational axis of the agitator 44 by the belt 45, the agitator 44 is rotated when the turbine 46 is rotated. If the agitator 44 is rotated, dusts on the floor are floated, thereby improving the cleaning efficiency.

When the suction hole (not shown) is blocked, air is bypassed and sucked into the suction nozzle 40 through the first and/or second bypass channel 50 and/or 49, so the suction motor (not shown) mounted in the vacuum cleaner is not overheated.

In addition, if foreign particles are accumulated in the mini nozzle 40 and cleaning is required, the upper and lower covers 41 ad 42 are dissembled and then the inside of the mini nozzle 40 is cleaned. At this time, a user pushes the push portion 52 by one hand to release combination between the first hooking protrusion 53 and the first slit 54, and grips and lifts the upper cover 41 by the other hand such that the upper cover 41 is separated from the lower cover 42. When combining the upper and lower covers 41 and 42, in a state that the front portion of the mini nozzle 40 is combined by inserting the second hooking protrusion 55 into a position corresponding to the second slit 56, the upper cover 41 is pushed downward.

Then, since the elastic hooking protrusion 51 is softly transformed, the first hooking protrusion 53 is pushed upward along the inner side of the upper cover 41, and then the first hooking protrusion 53 is finally inserted into the first slit 54, thereby completely combining the rear portion of the mini nozzle 40.

As one feature of the present invention, the second hooking protrusion 55 that is combined firstly is preferably formed in the upper cover 41 since the mini nozzle 40 is combined with the upper cover 41 being griped by a user. If the second slit 56 is formed in the upper cover 41, the user should make relatively more efforts in order to arrange the second slit 56.

Furthermore, after the upper and lower covers 41 and 42 are combined, the front portion of the mini nozzle 40 is fixed by means of the second hooking protrusion 55 and the second slit 56, and the rear portion of the mini nozzle 40 is fixed by means of the first hooking protrusion 53 and the first slit 54. Thus, the mini nozzle 40 may keep its perfect shape as a whole.

Figure 6:
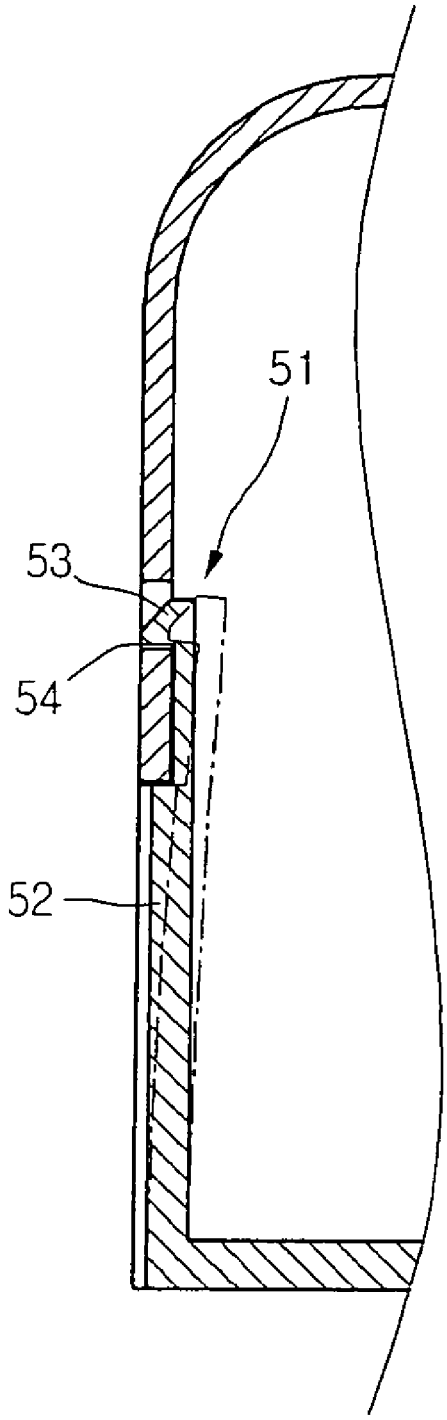
FIG. 6 is a sectional view taken along the line I-I' of FIG. 4.

FIG. 6 is a sectional view taken along the line I-I' of FIG. 4.

Referring to FIG. 6, the elastic hooking protrusion 51 formed by cutting away the main body of the lower cover 42 by a predetermined length is extended upward, and the first slit 54 is formed in the top of the elastic hooking protrusion 51. In addition, the first hooking protrusion 53 is inserted and fixed in the first slit 54.

In addition, as indicated by a hidden line, when a user pushes the push portion 52, the first hooking protrusion 53 is taken off from the first slit 54, so the hooking state of the upper and lower covers 41 and 42 is released. Of course, the upper and lower covers 41 and 42 may be separated in this state.

The present invention gives better convenience in manipulating the vacuum cleaner since a user may easily assemble and dissemble the suction nozzle.

In addition, the suction nozzle may be cleaned in a more convenient way.

In addition, in case that the spirit of the present invention is applied to the mini nozzle, user's convenience is much more enhanced since a user may separate the covers with gripping the upper and lower covers by both hands respectively.

In addition, the mini nozzle does not require any separate combination structure such as a screwing structure to combine the upper and lower covers, the overall configuration of the mini nozzle is more simplified and becomes smaller.

What is claimed is:

1. A vacuum cleaner, comprising:

a suction nozzle device;

a body that receives a dust collecting device in which foreign particles are separated from air sucked in through the suction nozzle device;

a manipulation handle formed at an upper portion of the body, to allow manipulation of the vacuum cleaner by a user;

a hose connecting the suction nozzle device with the body so as to act as an air passage;

a mini nozzle selectively connected with the hose;

a mini nozzle seat formed on the body, that selectively receives the mini nozzle;

upper and lower covers that form and protect upper and lower portions of the mini nozzle;

at least one elastic hooking protrusion integrally formed as one piece with a selected one of the upper and lower covers;

a plurality of elongated channels extending from an edge of the selected one of the upper and lower covers each said channel having an open end and a closed end, that allows the at least one elastic hooking protrusion to be transformed when pushed by a user, wherein the at least one elastic hooking protrusion is located between the plurality of channels; and at least one corresponding slit formed in the other one of the upper and lower covers such that the at least one elastic hooking protrusion is hooked thereto to fix the upper and lower covers.

2. The vacuum cleaner according to claim 1, wherein the mini nozzle seat is formed at a depressed portion of the body.

3. The vacuum cleaner according to claim 1, wherein the upper cover and the lower cover are independent parts from each other.

4. The vacuum cleaner according to claim 1, wherein at least one of the upper cover or the lower cover is provided with a bypass channel.

5. The vacuum cleaner according to claim 1, wherein the at least one elastic hooking protrusion is formed on a rear side of the suction nozzle device.

6. The vacuum cleaner according to claim 1, wherein the at least one elastic hooking protrusion is formed in the lower cover.

7. The vacuum cleaner according to claim 1, wherein the at least one elastic hooking protrusion comprises:

a push portion configured to be pushed by a user and having a first width, wherein the push portion is located between the plurality of channels; and a hooking protrusion that extends from the push portion and having a second width narrower than the first width, wherein the hooking protrusion is inserted in the at least one corresponding slit.

8. The vacuum cleaner according to claim 1, wherein the at least one elastic hooking protrusion is formed on both sides of the suction nozzle device, respectively.

9. The vacuum cleaner according to claim 1, wherein the at least one elastic hooking protrusion is provided with a substantially circular push portion.

10. The vacuum cleaner according to claim 1, wherein the at least one elastic hooking protrusion is formed on an edge of the lower cover.

11. The vacuum cleaner according to claim 1, further comprising a second elastic hooking protrusion and a second corresponding slit formed in a front portion of the upper and lower covers that allow the upper and lower covers to be latched and combined with each other.

12. A suction nozzle structure for a vacuum cleaner, comprising:

an upper cover that forms and protects an upper portion of the suction nozzle structure;

a lower cover that forms and protects a lower portion of the suction nozzle structure;

at least one elastic hooking protrusion integrally formed as one piece with a side of a selected one of the upper and lower covers, wherein the at least one elastic hooking protrusion includes a push portion configured to be pushed and a hooking protrusion that extends from the push portion;

a plurality of elongated channels extending from an edge of the selected one of the upper and lower covers each said channel having an open end and a closed end, that allows a transformation of the push portion when pushed by a user, wherein the push portion is located between the plurality of channels; and at least one corresponding slit formed in the other one of the upper and lower covers such that the at least one elastic hooking protrusion is partially inserted and fixed therein.

13. The suction nozzle structure according to claim 12, wherein the at least one elastic hooking protrusion is formed on a rear portion of the suction nozzle structure.

14. The suction nozzle structure according to claim 12, wherein the at least one elastic hooking protrusion is formed in the lower cover.

15. The suction nozzle structure according to claim 12, wherein the push portion includes a first width, and the hooking protrusion includes a second width narrower than the first width.

16. The suction nozzle structure according to claim 12, further comprising:

an additional slit formed in one of the upper and lower covers in which the at least one elastic hooking protrusion is formed, at a different position; and an additional elastic hooking protrusion formed in the other of the upper and lower covers at a position corresponding to the additional slit.

17. The suction nozzle structure according to claim 12, further comprising an additional hooking device formed in a front side of the suction nozzle structure.

18. The suction nozzle structure according to claim 12, wherein the at least one elastic hooking protrusion is formed in both sides of the suction nozzle structure, respectively.

19. An upright vacuum cleaner, comprising:

a main suction nozzle device that sucks outer air into a lower side of the upright vacuum cleaner;

a body that receives a dust collecting device in which foreign particles sucked in through the main suction nozzle device are collected;

a manipulation handle that allows manipulation of the upright vacuum cleaner by a user;

a hose that connects the main suction nozzle device with the body;

a mini nozzle selectively connected with the hose and formed and protected by at least two covers;

at least one elastic hooking protrusion integrally formed as one piece with a side of a selected one of the covers;

a plurality of elongated channels extending from an edge of the selected one of the covers each said channel having an open end and a closed end, that allows a transformation of a push portion of the at least one hooking protrusion when pushed by a user, wherein the at least one elastic protrusion is located between the plurality of channels; and at least one corresponding slit formed in the other one of the covers such that the at least one elastic hooking protrusion is partially inserted and fixed therein.

* * * * *